US006588757B1

(12) United States Patent
Lo

(10) Patent No.: US 6,588,757 B1
(45) **Date of Patent: *Jul. 8, 2003**

(54) CARD GAME

(76) Inventor: Henry Tien Lo, 5010 Indian River Dr., Apartment 32, Las Vegas, NV (US) 89103

( * ) Notice: Subject to any disclaimer, the term of this patent is extended or adjusted under 35 U.S.C. 154(b) by 0 days.

This patent is subject to a terminal disclaimer.

(21) Appl. No.: 09/627,844

(22) Filed: Jul. 28, 2000

Related U.S. Application Data

(60) Provisional application No. 60/146,431, filed on Jul. 30, 1999.

(51) Int. Cl.[7] ..... A63F 1/00
(52) U.S. Cl. ..... 273/292; 273/279
(58) Field of Search ..... 273/292, 279, 273/309, 148

(56) References Cited

U.S. PATENT DOCUMENTS 4,861,041 A * 8/1989 Jones et al.
5,248,142 A * 9/1993 Breeding
5,452,899 A * 9/1995 Skratulia et al.
5,772,211 A * 6/1998 Nazaryan et al. ..... 273/292
5,799,945 A * 9/1998 Boylan et al.
5,810,354 A * 9/1998 Banyai
5,839,731 A * 11/1998 Feola
5,851,011 A * 12/1998 Lott
5,863,042 A * 1/1999 Lo ..... 273/292
5,882,009 A * 3/1999 Schaefer
5,901,958 A * 5/1999 Andrews
5,911,419 A * 6/1999 Delaney et al.
5,944,315 A * 8/1999 Mostashari
5,975,529 A * 11/1999 de Keller
5,984,309 A * 11/1999 Santin
6,042,118 A * 3/2000 Poitra
6,299,170 B1 * 10/2001 Yoseloff

* cited by examiner

*Primary Examiner*—Paul T. Sewell
*Assistant Examiner*—Nini F. Legesse
(74) *Attorney, Agent, or Firm*—Elman Technology Law, PC; Gerry J. Elman

(57) ABSTRACT

The card game of the present invention uses at least one or preferably one standard deck of 52 cards plus at least one or preferably four Jokers. Each Player, along with the Banker, is dealt seven cards, and plays against a Banker. In any given hand, Players have the option to make from one and up to eight different types of bets on the value of their own hand. A Player's wager wins if the Player's best five-card poker hand selected from the Player's seven dealt cards is one of the winning hands of the bet the Player makes, and the Player's wager loses if the Player's best five-card poker hand is neither one of the winning hands nor one of the pushing hand(s). If a Player makes more than one bet, the Player may win all bets made, the Player may win some bet(s) and lose the other(s), or the Player may lose all bets made. The eight types of bets do not require skill; Players win their wagers based on the strength of the hands as dealt.

15 Claims, 2 Drawing Sheets

TABLE LAYOUT OF WILD 7 CARD THRILL - EIGHT BETS VERSION

TABLE LAYOUT OF WILD 7 CARD THRILL - TWO BETS VERSION

CARD GAME

CROSS REFERENCE TO RELATED APPLICATION

Figure 1:
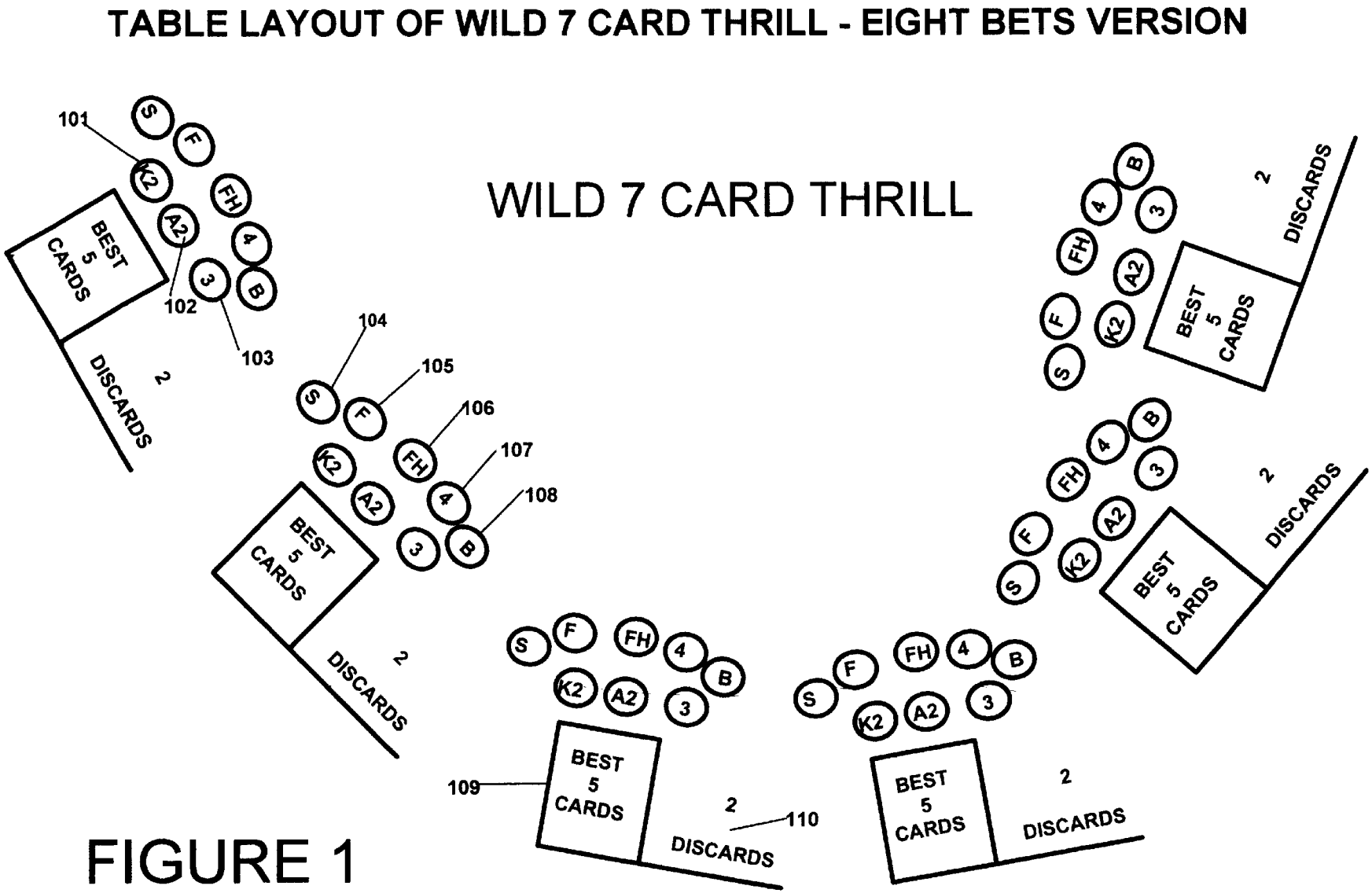

This application claims priority under 35 U.S.C. §119(2) from the following U.S. provisional patent applications: Ser. No. 60/146,431 filed Jul. 30, 1999, which is incorporated by the reference.

FIELD OF THE INVENTION

The present invention generally relates to card games and, in particular, to card games for use in casinos and cardrooms.

SUMMARY OF THE INVENTION

An embodiment of the present invention is offered under the trademark Wild 7 Card Thrill. The present invention is a seven-card-stub poker game, played with at least one standard poker deck of 52 cards plus one or more Jokers, preferably four Jokers. Each Joker can be used as any card to form a pair, 3 of a Kind, Straight, Flush, Full House, 4 of a Kind, 5 of a Kind, Straight Flush or Royal Flush. All Players play against the Casino Dealer (Banker) or the Player Banker (another Player who acts as the Banker in the cardroom setting).

After a Player has made at least one bet on the value of the Player's own hand, the Player is dealt seven cards, and then the Player must select the best five-card poker hand from the Player's seven cards; the Player's wager wins if the Player's best five-card poker hand is one of the winning hands of the bet the Player bets on; if the Player's best five-card poker hand is neither one of the winning hands nor a pushing hand (the hand that is considered as a tie for the bet), the Player loses the wager.

The present invention consists of eight types of bets: Kings Two Pair Or Better Bet, Aces Two Pair Or Better Bet, 3 Of A Kind Or Better Bet, Straight Or Better Bet, Flush Or Better Bet, Full House Or Better Bet, 4 Of A Kind Or Better Bet and Bonus Bet, and their respective, appropriate payout odds.

It is an advantage of the present invention that it provides familiar elements of traditional poker, is easy to be learned and played by new Players, as well as easy to be learned and managed by card dealers. It is an advantage that since a hand has only one way setting and no additional bet is allowed after cards are dealt, and Players have no more decisions to make, therefore, Players are able to relax and enjoy reading their cards, having pleasant gaming experiences. Another advantage is that in a casino setting, the game is played in a non-adversarial, friendly social atmosphere because Players play against the House, not against other Player(s).

DESCRIPTION OF PREFERRED EMBODIMENTS

A preferred embodiment of the present invention provides a seven-card stud poker game, played with at least one standard poker deck of 52 cards plus four Jokers. Other embodiments contemplate a version that would be played with at least standard poker deck of 52 cards plus no Joker wherein either four Deuces, four Threes, four Fours, four Fives, four Sixes, four Sevens, four Eights, four Nines, four Tens, four Jacks, four Queens, four Kings, or four Aces are Wild Cards. Each Joker, along with each Wild Card, can be used as any card to form a Pair, 3 of a Kind, Straight, Flush, Full House, 4 of a Kind, Straight Flush, 5 of a Kind, Wild Royal Flush (Royal Flush with one or more Jokers or Wild Cards) or Natural Royal Flush (Royal Flush without Jokers nor Wild Cards).

Another preferred embodiment of the present invention offers eight types of bets. Other embodiments offer any one, any two, any three, any four, any five, any six, any seven of eight types of bets. Wager(s) must be placed before each Player, along with the Banker, is dealt a hand. A Player's wager wins if the Player's best five-card poker hand selected from the Player's own seven cards is one of the winning hands of the type of bet the Player bets on; the Player's wager loses if the Player's best five-card poker hand is neither one of the winning hands nor a pushing hand (a hand that is considered as a tie for the bet). If a Player makes more than one bet, the Player may win all bets made, the Player may win some bet(s) and lose the other(s), or the Player may lose all bets made.

An embodiment of the present invention is offered under the trademark Wild 7 Card Thrill, wherein the eight types of bets Wild 7 Card Thrill offers are: Kings Two Pair Or Better Bet, Aces Two Pair Or Better Bet, 3 Of A Kind Or Better Bet, Straight Or Better Bet, Flush Or Better Bet, Full House Or Better Bet, 4 Of A Kind Or Better Bet and Bonus Bet.

Eight Bets Offered

Kings Two Pair Or Better Bet: A Player's Kings Two Pair Or Better bet wins if the Player's best five-card poker hand is Aces Two Pair, 3 of a Kind, Straight, Flush, Full House, 4 of a Kind, Straight Flush, 5 of a Kind, Wild Royal Flush or Natural Royal Flush and is paid Even Money (1 to 1); the Player's bet pushes if the Player's best five-card poker hand is Kings Two Pair. The Player's bet loses if the Player's best five-card poker hand is not any one of the above hands (including Kings Two Pair). This payout odds yields about 1.99% house advantage. Alternatively, other appropriate payout odds can be used.

Aces Two Pair Or Better Bet: A Player's Aces Two Pair Or Better bet wins if the Player's best five-card poker hand is Aces Two Pair, 3 of a Kind, Straight, Flush, Full House, 4 of a Kind, Straight Flush, 5 of a Kind, Wild Royal Flush or Natural Royal Flush. The Player's bet loses if the Player's best five-card poker hand is any other type of hand. Aces Two Pair Or Better Bet pays Even Money (1 to 1) on a hand of Aces Two Pair, 3 of a Kind, Straight, Flush, Full House or 4 of a Kind, and pays 2 to 1 on a hand of Straight Flush, 5 of a Kind, wild Royal Flush or Natural Royal Flush. This payout odds yields about 2.16% house advantage. Alternatively, other appropriate payout odds can be used.

3 Of A Kind Or Better Bet: A Player's 3 Of A Kind Or Better bet wins if the Player's best five-card poker hand is 3 of a Kind, Straight, Flush, Full House, 4 of a Kind, Straight Flush, 5 of a Kind, Wild Royal Flush or Natural Royal Flush. The Player's bet loses if the Player's best five-card poker hand is any other type of hand. 3 Of A Kind Or Better Bet pays Even Money (1 to 1) on a hand of 3 of a Kind, Straight or Flush, and pays 3 to 2 on a hand of Full House, 4 of a Kind, Straight Flush, 5 of a Kind, Wild Royal Flush or Natural Royal Flush. This payout odds yields about 2.395% house advantage. Alternatively, other appropriate payout odds can be used.

Straight Or Better Bet: A Player's Straight Or Better bet wins if the Player's best five-card poker hand is Straight, Flush, Full House, 4 of a Kind, Straight Flush, 5 of a Kind, Wild Royal Flush or Natural Royal Flush. The Player's bet loses if the Player's best five-card poker hand is any other type of hand. Straight Or Better Bet pays 2 to 1 on a hand of Straight, Flush or Full House, and pays 5 to 2 on a hand of 4 of a Kind, Straight Flush, 5 of a Kind, Wild Royal Flush or Natural Royal Flush. This payout odds yields about 3.175% house advantage. Alternatively, other appropriate payout odds can be used.

Flush Or Better Bet: A Player's Flush Or Better bet wins if the Player's best five-card poker hand is Flush, Full House, 4 of a Kind, Straight Flush, 5 of a Kind, Wild Royal Flush or Natural Royal Flush. The Player's bet loses if the Player's best five-card poker hand is any other type of hand. Flush Or Better Bet pays 4 to 1 on a hand of Flush, Full House or 4 of a Kind, and pays 6 to 1 on a hand of Straight Flush, 5 of a Kind, Wild Royal Flush or Natural Royal Flush. This payout odds yields about 3.59% house advantage. Alternatively, other appropriate payout odds can be used.

Full House Or Better Bet: A Player's Full House Or Better bet wins if the Player's best five-card poker hand is Full House, 4 of a Kind, Straight Flush, 5 of a Kind, Wild Royal Flush or Natural Royal Flush. The Player's bet loses if the Player's best five-card poker hand is any other type of hand. Full House or Better Bet pays 7 to 1 on any one of the winning hands. This payout odds yields about 4.88% house advantage. Alternatively, other appropriate payout odds can be used.

4 Of A Kind Or Better Bet: A Player's 4 Of A Kind Or Better bet wins if the Player's best five-card poker hand is 4 of a Kind, Straight Flush, 5 of a Kind, Wild Royal Flush or Natural Royal Flush. The Player's bet loses if the Player's best five-card poker hand is any other type of hand. 4 Of A Kind Or Better Bet pays 15 to 1 on any one of the winning hands. This payout odds yields about 5.44% house advantage. Alternatively, other appropriate payout odds can be used.

Bonus Bet: Either one of the following three types of games (versions) can be used for Bonus Bet game:

1) A player's Bonus bet wins if the player's best 5-card poker hand is Full House, 4 of a Kind, Straight Flush, 5 of a Kind, Wild Royal Flush or Natural Royal Flush. The winning hand will be paid as follows:

| Winning Hand | Payout Odds |
|---|---|
| Natural Royal Flush | 2,000 to 1 |
| Wild Royal Flush | 60 to 1 |
| 5 of a Kind | 40 to 1 |
| Straight Flush | 15 to 1 |
| 4 of a Kind | 3 to 1 |
| Full House | 2 to 1 |

This pay table yields about 11.22% house advantage. Alternatively, Any other appropriate pay table can be used.

2) A Player's Bonus bet wins if the Player's best five-card poker hand is 4 of a Kind, Straight Flush, 5 of a Kind, Wild Royal Flush or Natural Royal Flush. The Player's Bonus bet loses if the Player's best five-card poker hand is any other type of hand. The winning bet is paid as follows:

| Winning Hand | Payout Odds |
|---|---|
| Natural Royal Flush | 2,000 to 1 |
| Wild Royal Flush | 100 to 1 |
| 5 of a Kind | 30 to 1 |
| Straight Flush | 20 to 1 |
| 4 of a Kind | 4 to 1 |

This pay table yields about 14.85% house advantage. Alternatively, other appropriate pay table can be used.

3) A Player's Bonus bet wins if the Player's best five-card poker hand is 4 of a Kind, Straight Flush, 5 of a Kind, Wild Royal Flush or Natural Royal Flush, and the Player's Bonus bet loses if the Player's best five-card poker hand is any other type of hand. The winning bet is paid as follows:

| Winning Hand | Payout Odds |
|---|---|
| Natural Royal Flush | 2,500 to 1 |
| Wild Royal Flush | 100 to 1 |
| 5 of a Kind | 30 to 1 |
| Straight Flush | 20 to 1 |
| 4 of a Kind | 4 to 1 |

This pay table yields about 13.42% house advantage. Alternatively, other appropriate pay table can be used.

Rules of regarding Banker's hand: Although the Dealer is also dealt seven cards, the Banker's hand is not considered for play if Players are not allowed to bet on the value of the Banker's hand; the Banker's is considered for play if Players are allowed to bet on the value of the Banker's hand. Either one of the two rules can be chosen to be part of the game rules.

Besides Wild 7 Card Thrill is played with a standard deck of 52 cards plus four Jokers, this version is identified as Wild 7 Card Thrill I, Wild 7 Card Thrill can also be played with a standard deck of 52 cards, where either four Deuces, four Threes, four Fours, four Fives, four Sixes, four Sevens, four Eights, four Nines, four Tens, four Jacks, four Queens, four Kings, or four Aces are Wild Cards. Each Wild Card can be used as any card, to form a pair, 3 of a Kind, Straight, Flush, Full House, 4 of a Kind, Straight Flush, 5 of a Kind or Royal Flush, this version is identified as Wild 7 Card Thrill II. In Wild 7 Card Thrill II, the game rules of number of hands dealt each round of play, seven cards each hand (in each Player's hand and in Banker's hand), and each Player and Banker select their best five-card poker hand from either their own seven cards or their own card(s) plus the community card(s) or the whole seven community cards, are same as the game rules of Wild 7 Card Thrill I. Wild 7 Card Thrill II also offers the same types of bets (same bet names) as Wild 7 Card Thrill I, and the winning hands and the payout odds for each same type of bet of the two versions can be identical or different.

The Deal

Table size, management of Players and their bets, and speed of play are part of the choice of that the maximum number of hands dealt from at least one standard poker deck of 52 cards plus four Jokers in any given round of play is "seven." Alternatively, lesser or greater than seven hands are contemplated in accordance with this invention.

In the preferred embodiment, after all Players have placed their wagers, each Player will receive one seven-card dealt hand and the Banker will receive one seven-card dealt hand, starting from the Player sitting to the Dealer's immediate left, continuing in a clockwise fashion and ending with the Dealer. Cards may be dealt seven at a time, or preferably one at a time. Other traditional methods used in poker games may be used for the deal.

In another embodiment, after all Players have placed their wagers, each Player and the Banker, will receive their hand in either one of the following fashions:

1. they receive their own six cards and one community card;
2. they receive their own five cards and two community cards;

3. they receive their own four cards and three community cards;
4. they receive their own three cards and four community cards;
5. they receive their own two cards and five community cards;
6. they receive their own one card and six community cards; and
7. they receive no card their own and seven community cards.

Tables for Use in Play

Figure 2:
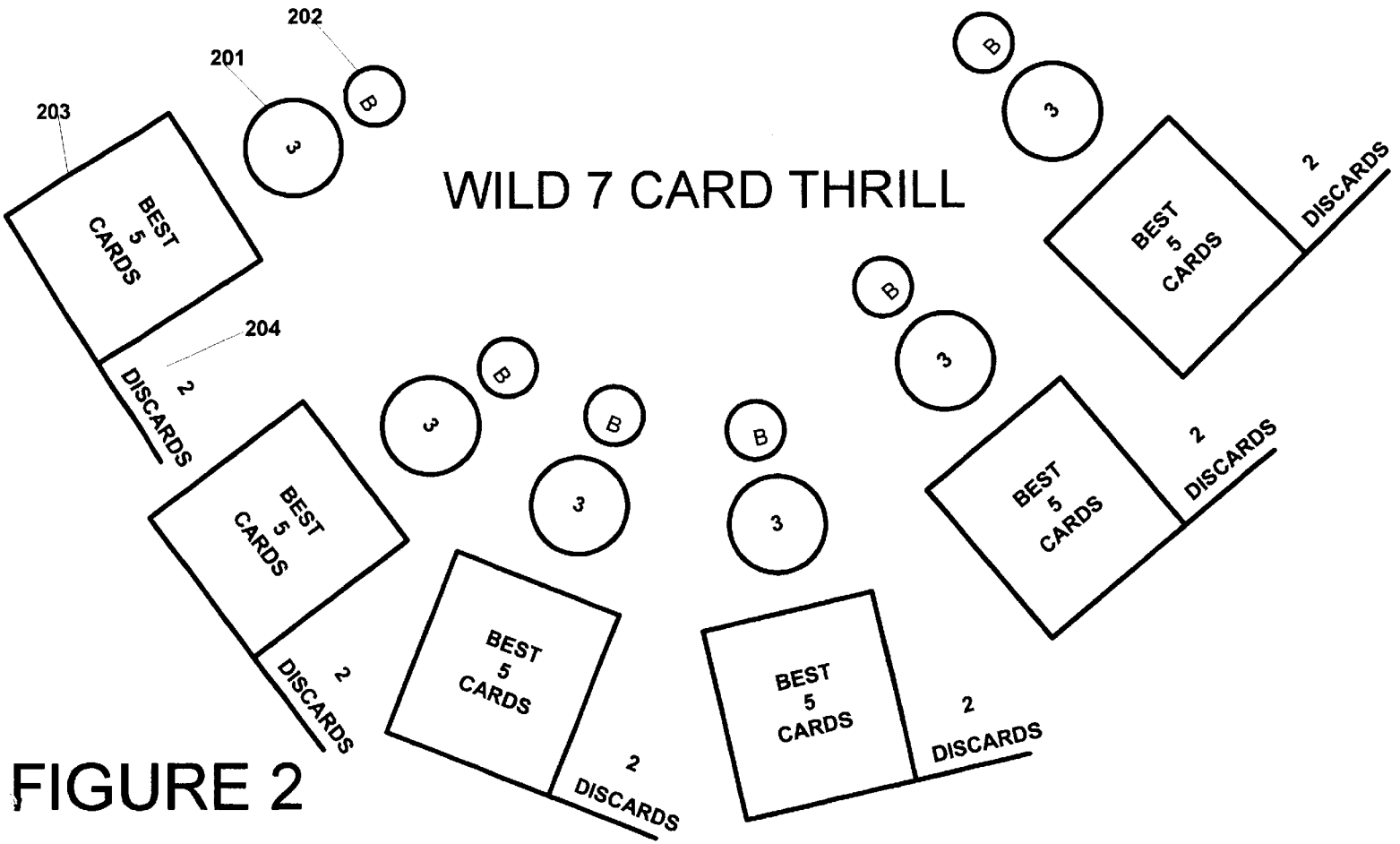

Play may be facilitated by using tables configured and marked as shown in FIGS. 1 and 2. Referring to FIG. 1, it shows a casino table playing surface of the eight-bet version; a Player may make one or more bets on Kings Two Pair Or Better Bet area 101, Aces Two Pair Or Better Bet area 102, 3 Of A Kind Or Better Bet area 103, Straight Or Better Bet area 104, Flush Or Better Bet area 105, Full House Or Better Bet area 106, 4 Of A Kind Or Better Bet area 107 and Bonus Bet area 108; when the Player sets his or her hand, the best five cards of the hand are placed in the hand area 109 and the lowest two cards of the hand in the hand area 110. Referring to FIG. 2, it shows a casino table playing surface of the two-bet version; a Player may make one or two bets on 3 Of A Kind Or Better Bet area 201 and Bonus Bet area 202; when the Player sets his or her hand, the best five cards of the hand are placed in the hand area 203 and the lowest two cards of the hand in the hand area 204.

Other appropriate playing surfaces may be used in connection with the card game of the present invention.

Wagers are placed with money or chips representing money or other means used in the art.

What is claimed is:

1. A method of playing a card game among a plurality of Players and a Banker, each Player wagering against the Banker, the method comprising the following steps:

(a) providing and shuffling at least one standard poker deck of 52 cards plus four Jokers or at least one standard deck of 52 cards wherein either four Deuces, four Threes, four Fours, four Fives, four Sixes, four Sevens, four Eights, four Nines, four Tens, four Jacks, four Queens, four Kings, or four Aces are Wild Cards;

(b) each Player placing at least one wager of Kings Two Pair Or Better Bet, Aces Two Pair Or Better Bet, 3 Of A Kind Or Better Bet, Straight Or Better Bet, Flush Or Better Bet, Full House Or Better Bet, 4 Of A Kind Or Better Bet and Bonus Bet;

(c) dealing cards into enough dealt hands of seven cards to provide a dealt hand for the Banker and for each Player;

(d) determining which dealt hand is assigned to each Player and which dealt hand is assigned to the Banker;

(e) from each Player's own seven dealt cards, he or she selecting his or her best 5-card poker hand and discarding two other cards;

(f) determining whether each Player's wager or wagers win, lose or tie;

wherein each of said Jokers or Wild Cards may be used as any card;

wherein a Player's Kings Two Pair Or Better Bet wager wins if the Player's best 5-card poker hand is Aces Two Pair, 3 of a Kind, Straight, Flush, Full House, 4 of a kind, Straight Flush, 5 of a Kind or Royal Flush, and is paid according to a predetermined pay table;

wherein the player's said wager pushes and no money is won or lost if the Player's best 5-card poker hand is Kings Two Pair;

wherein the Player's said wager loses if the Player's best 5-card poker hand is neither one of the aforesaid winning hands nor Kings Two Pair;

wherein a Player's Aces Two Pair Or Better Bet wager wins if the Player's best 5-card poker hand is Aces Two Pair, 3 of a Kind, Straight, Flush, Full House, 4 of a Kind, Straight Flush, 5 of a Kind or Royal Flush, and is paid according to a predetermined pay table; wherein the Player's said wager loses if the Player's best 5-card poker hand is not one of the aforesaid winning hands;

wherein a Player's 3 Of A Kind Or Better Bet wager wins if said Player's best 5-card poker hand is 3 of a Kind, Straight, Flush, Full House, 4 of a Kind, Straight Flush, 5 of a Kind or Royal Flush, and is paid according to a predetermined 3 Of A Kind Or Better Bet pay table; wherein the player's said wager loses if the Player's best 5-card poker hand is not one of the aforesaid winning hands;

wherein a Player's Straight Or Better Bet wager wins if said Player's best 5-card poker hand is Straight, Flush, Full House, 4 of a Kind, Straight Flush, 5 of a Kind or Royal Flush, and is paid according to a predetermined pay table; wherein the player's said wager loses if the Player's best 5-card poker hand is not one of the aforesaid winning hands;

wherein a Player's Flush Or Better Bet wager wins if said Player's best 5-card poker hand is Flush, Full House, 4 of a Kind, Straight Flush, 5 of a Kind or Royal Flush, and is paid according to a predetermined pay table; wherein the player's said wager loses if the Player's best 5-card poker hand is not one of the aforesaid winning hands;

wherein a Player's Full House Or Better Bet wager wins if said Player's best 5-card poker hand is Full House, 4 of a Kind, Straight Flush, 5 of a Kind or Royal Flush, and is paid according to a predetermined pay table; wherein the Player's said wager loses if the Player's best 5-card poker hand is not one of the aforesaid winning hands;

wherein a Player's 4 Of A Kind Or Better Bet wager wins if said Player's best 5-card poker hand is 4 of a Kind, Straight Flush, 5 of a Kind or Royal Flush, and is paid according to a predetermined pay table; wherein the player's said wager loses if the Player's best 5-card poker hand is not one of the aforesaid winning hands;

wherein a Player's Bonus Bet wager wins if the Player's best 5-card poker hand is Full House, 4 of a Kind, Straight Flush, 5 of a Kind or Royal Flush, and is paid according to a predetermined pay table; wherein the Player's Bonus Bet wager loses if the Player's best 5-card poker hand is not one of the aforesaid winning hands; and (g) settling each Player's wager or wagers against the Banker.

2. The method of playing a card game according to claim 1, wherein the card game offers either any one, any two, any three, any four, any five, any six, or any seven of the eight types of bets mentioned above.

3. The method of playing a card game according to claim 1, wherein one of the bets the card game offers is Kings Two Pair Or Better Bet; wherein a Player's Kings Two Pair Or Better bet wins if the Player's best five-card poker hand is Aces Two Pair, 3 of a Kind, Straight, Flush, Full House, 4 of a Kind, Straight Flush, 5 of a Kind, Wild Royal Flush or Natural Royal Flush and is paid Even Money (1 to 1); wherein a Player's Kings Two Pair Or Better bet pushes if the Player's best five-card poker hand is Kings Two Pair and no money is won or lost; wherein a Player's Kings Two Pair Or Better bet loses if the Player's best five-card poker hand is not Kings Two Pair, Aces Two Pair, 3 of a Kind, Straight, Flush, Full House, 4 of a Kind, Straight Flush, 5 of a Kind, Wild Royal Flush or Natural Royal Flush.

4. The method of playing a card game according to claim 1, wherein one of the bets the card game offers is Aces Two Pair Or Better Bet;

wherein a Player's Aces Two Pair Or Better bet wins if the Player's best five-card poker hand is Aces Two Pair, 3 of a Kind, Straight, Flush, Full House, 4 of a Kind, Straight Flush, 5 of a Kind, Wild Royal Flush or Natural Royal Flush, and this bet loses if the Player's best five-card poker hand is any other type of hand;

wherein Aces Two Pair Or Better Bet pays Even Money (1 to 1) on a hand of Aces Two Pair, 3 of a Kind, Straight, Flush, Full House or 4 of a Kind, and pays 2 to 1 on a hand of Straight Flush, 5 of a Kind, Wild Royal Flush or Natural Royal Flush.

5. The method of playing a card game according to claim 1, wherein one of the bets the card game offers is 3 Of A Kind Or Better Bet;

wherein a Player's 3 Of A Kind Or Better bet wins if the Player's best five-card poker hand is 3 of a Kind, Straight, Flush, Full House, 4 of a Kind, Straight Flush, 5 of a Kind, Wild Royal Flush or Natural Royal Flush, and this bet loses if the Player's best five-card poker hand is any other type of hand;

wherein 3 Of A Kind Or Better Bet pays Even Money (1 to 1) on a hand of 3 of a Kind, Straight or Flush, and pays 3 to 2 on a hand of Full House, 4 of a Kind, Straight Flush, 5 of a Kind, Wild Royal Flush or Natural Royal Flush.

6. The method of playing a card game according to claim 1, wherein one of the bets the card game offers is Straight Or Better Bet;

wherein a Player's Straight Or Better bet wins if the Player's best five-card poker hand is Straight, Flush, Full House, 4 of a Kind, Straight Flush, 5 of a Kind, Wild Royal Flush or Natural Royal Flush, and this bet loses if the Player's best five-card poker hand is any other type of hand;

wherein Straight Or Better Bet pays 2 to 1 on a hand of Straight, Flush or Full House, and pays 5 to 2 on a hand of 4 of a Kind, Straight Flush, 5 of a Kind, Wild Royal Flush or Natural Royal flush.

7. The method of playing a card game according to claim 1, wherein one of the bets the card game offers is Flush Or Better Bet;

wherein a Player's Flush Or Better bet wins if the Player's best five-card poker bet is Flush, Full House, 4 of a Kind, Straight Flush, 5 of a Kind, Wild Royal Flush or Natural Royal Flush, and this bet loses if the Player's best five-card poker hand is any other type of hand;

wherein Flush Or Better Bet pays 4 to 1 on a hand of Flush, Full House or 4 of a Kind, and pays 6 to 1 on a hand of Straight Flush, 5 of a Kind, Wild Royal Flush or Natural Royal Flush.

8. The method of playing a card game according to claim 1, wherein one of the bets the card game offers is Full House Or Better Bet;

wherein a Player's Full House Or Better bet wins if the Player's best five-card poker hand is Full House, 4 of a Kind, Straight Flush, 5 of a Kind, Wild Royal Flush or Natural Royal Flush, and this bet loses if the best five-card poker hand is any other type of hand;

wherein Full House Or Better Bet pays 7 to 1 on any one of the winning hands.

9. The method of playing a card game according to claim 1, wherein one of the bets the card game offers is 4 Of A Kind Or Better Bet;

wherein a Player's 4 Of A Kind Or Better bet wins if the Player's best five-card poker hand is 4 of a Kind, Straight Flush, 5 of a Kind, Wild Royal Flush or Natural Royal Flush, and this bet loses if the Player's best five-card poker hand is any other type of hand;

wherein 4 Of A Kind Or Better Bet pays 15 to 1 on any one of the winning hands.

10. The method of playing a card game according to claim 1, wherein one of the bets the card game offers is Bonus Bet; wherein a Player's Bonus bet wins if the Players best five-card poker hand is Full House, 4 of a Kind, Straight Flush, 5 of a Kind, Wild royal Flush or Natural Royal Flush, and this bet loses if the Players best five-card poker hand is any other type of hand; wherein Bonus Bet pays 2 to 1 on a hand of Full House, 3 to 1 on 4 of a Kind, 15 to 1 on Straight Flush, 40 to 1 on 5 of a Kind, 60 to 1 on Wild Royal Flush and 2000 to 1 on Natural Royal Flush.

11. The method of playing a card game according to claim 1, wherein one of the bets the card game offers is Bonus Bet;

wherein a Player's Bonus bet wins if the Player's best five-card poker hand is 4 of a Kind, Straight Flush, 5 of a Kind, Wild Royal Flush or Natural Royal Flush, and this bet loses if the Player's best five-card poker hand is any other type of hand;

wherein Bonus Bet pays 4 to 1 on a hand of 4 of a Kind, 20 to 1 on Straight Flush, 30 to 1 on 5 of a Kind, 100 to 1 on Wild Royal Flush, and either 2000 to 1 or 2500 to 1 on Natural Royal Flush.

12. The method of playing a card game according to claim 1, wherein every Player and Banker receive their seven cards in a combination of at least one community card and zero to six of their own dealt cards.

13. The method of playing a card game according to claim 1, wherein Players are permitted to bet on the value of the Banker's hand; and wherein the Banker's hand does play.

14. A method of playing a card game among a plurality of Players and a Banker, each Player wagering against the Banker, the method comprising the following steps:

(d) providing and shuffling at least one standard poker deck of 52 cards plus at least one Joker or at least one standard deck of 52 cards wherein either four Deuces, four Threes, four Fours, four Fives, four Sixes, four Sevens, four Eights, four Nines, four Tens, four Jacks, four Queens, four Kings, or four Aces are Wild Cards;

(e) each Player placing at least one wager of Kings Two Pair Or Better Bet, Aces Two Pair Or Better Bet, 3 Of A Kind Or Better Bet, Straight Or Better Bet, Flush Or Better Bet, Full House Or Better Bet, 4 Of A Kind Or Better Bet and Bonus Bet;

(f) dealing cards into enough dealt hands of seven cards to provide a dealt hand for the Banker and for each Player;

(f) determining which dealt hand is assigned to each Player and which dealt hand is assigned to the Banker;

(g) from each Player's own seven dealt cards, he or she selecting his or her best 5-card poker hand and discarding two other cards;

(f) determining whether each Player's wager or wagers win, lose or tie;

wherein each of said Jokers or Wild Cards may be used as any card;

wherein a Player's Kings Two Pair Or Better Bet wager wins if the Player's best 5-card poker hand is Aces Two Pair, 3 of a Kind, Straight, Flush, Full House, 4 of a kind, Straight Flush, 5 of a Kind or Royal Flush, and is paid according to a predetermined pay table; wherein the player's said wager pushes and no money is won or lost if the Player's best 5-card poker hand is Kings Two Pair; wherein the Player's said wager loses if the Player's best 5-card poker hand is neither one of the aforesaid winning hands nor Kings Two Pair;

wherein a Player's Aces Two Pair Or Better Bet wager wins if the Player's best 5-card poker hand is Aces Two Pair, 3 of a Kind, Straight, Flush, Full House, 4 of a Kind, Straight Flush, 5 of a Kind or Royal Flush, and is paid according to a predetermined pay table; wherein the Player's said wager loses if the Player's best 5-card poker hand is not one of the aforesaid winning hands;

wherein a Player's 3 Of A Kind Or Better Bet wager wins if said Player's best 5-card poker hand is 3 of a Kind, Straight, Flush, Full House, 4 of a Kind, Straight Flush, 5 of a Kind or Royal Flush, and is paid according to a predetermined pay table; wherein the player's said wager loses if the Player's best 5-card poker hand is not one of the aforesaid winning hands;

wherein a Player's Straight Or Better Bet wager wins if said Player's best 5-card poker hand is Straight, Flush, Full House, 4 of a Kind, Straight Flush, 5 of a Kind or Royal Flush, and is paid according to a predetermined pay table; wherein the player's said wager loses if the Player's best 5-card poker hand is not one of the aforesaid winning hands;

wherein a Player's Flush Or Better Bet wager wins if said Player's best 5-card poker hand is Flush, Full House, 4 of a Kind, Straight Flush, 5 of a Kind or Royal Flush, and is paid according to a predetermined pay table; wherein the player's said wager loses if the Player's best 5-card poker hand is not one of the aforesaid winning hands;

wherein a Player's Full House Or Better Bet wager wins if said Player's best 5-card poker hand is Full House, 4 of a Kind, Straight Flush, 5 of a Kind or Royal Flush, and is paid according to a predetermined pay table; wherein the Player's said wager loses if the Player's best 5-card poker hand is not one of the aforesaid winning hands;

wherein a Player's 4 Of A Kind Or Better Bet wager wins if said Player's best 5-card poker hand is 4 of a Kind, Straight Flush, 5 of a Kind or Royal Flush, and is paid according to a predetermined pay table; wherein the player's said wager loses if the Player's best 5-card poker hand is not one of the aforesaid winning hands;

wherein a Player's Bonus Bet wager wins if the Player's best 5-card poker hand is Full House, 4 of a Kind, Straight Flush, 5 of a Kind or Royal Flush, and is paid according to a predetermined pay table; wherein the Player's Bonus Bet wager loses if the Player's best 5-card poker hand is not one of the aforesaid winning hands; and (g) settling each Player's wager or wagers against the Banker.

15. The method of playing a card game according to claim 14, wherein every Player and Banker receive their seven cards in a combination of at least one community card and zero to six of their own dealt cards.

* * * * *